US006374562B1

(12) United States Patent
Crowly

(10) Patent No.: US 6,374,562 B1
(45) Date of Patent: Apr. 23, 2002

(54) ADJUSTABLY SIZEABLE RAISED PANEL SYSTEM FOR STAIRS AND METHOD FOR FORMING AND INSTALLING SAME

(75) Inventor: John S. Crowly, Falmouth, ME (US)

(73) Assignee: New England Classic Interiors, Inc., Portland, ME (US)

( * ) Notice: Subject to any disclaimer, the term of this patent is extended or adjusted under 35 U.S.C. 154(b) by 0 days.

(21) Appl. No.: 09/605,251

(22) Filed: Jun. 28, 2000

(51) Int. Cl.[7] ..... E04B 2/08

(52) U.S. Cl. ..... 52/506.01; 52/182; 52/589.1; 52/592.1; 52/741.2; 52/747.1

(58) Field of Search ..... 52/182, 184, 506.01, 52/589.1, 591.1, 592.1, 797.1, 799.1, 741.2, 747.1

(56) References Cited

U.S. PATENT DOCUMENTS

| | | | | |
|---|---|---|---|---|
| 741,524 A | | 10/1903 | Miller | |
| 2,594,928 A | | 4/1952 | Horowitz | |
| 3,616,120 A | * | 10/1971 | Warwick | 428/81 |
| 3,981,112 A | | 9/1976 | Dake | |
| 4,557,096 A | | 12/1985 | Hovde | |
| 4,724,638 A | | 2/1988 | Bezborodko | |
| 4,736,559 A | | 4/1988 | Young | |
| 5,056,283 A | | 10/1991 | Sapinski | |
| 5,526,857 A | | 6/1996 | Forman | |
| 5,860,260 A | * | 1/1999 | Hase | 52/307 |
| 5,884,444 A | | 3/1999 | Harris | |
| 5,894,701 A | | 4/1999 | Delorme | |

FOREIGN PATENT DOCUMENTS

CH 134020 11/1929

OTHER PUBLICATIONS

Crowley et al., pending U.S. Pat. application Ser. No. 09/640,980, filed Aug. 17, 2000, entitled "Modular Wall Panel System".

Stair–Pak, Panel–Pak Wainscoting, Stair–Pak Products Co., Inc., Sold Since 1989, 4 pages.

Contract Joinery, Ken Austin, pp. 79–84, First U.S. Publication Aug. 1988.

(List continued on next page.)

*Primary Examiner*—Beth A. Stephan
*Assistant Examiner*—Brian E. Glessner
(74) *Attorney, Agent, or Firm*—Heslin Rothenberg Farley & Mesiti P.C.

(57) ABSTRACT

An adjustably sizeable raised panel system is disclosed which is attachable to a lower outer surface portion of a wall along flights of stairs having different rises and runs or slopes. The system includes adjustably sizeable raised panels which include a parallelogram-shaped member having a pair of vertically-extending sides and parallel angled top and bottom sides. The top and bottom sides of the panels have a longer peripherally-extending portion compared to the peripherally-extending portions of the vertically-extending sides. This allows a carpenter to cut or trim the top and bottom sides on the job site to correspond to the slope of the flight of stairs. Desirably, the relieved portion is disposed on an angle of either about 37 degrees or about 41 degrees which allows adjustment, e.g., trimming of the edges of the top and bottom sides, up to plus or minus 1¾ degrees to match the actual angle of a residential flight of stairs without the difference between the angle of the relieved portion and slope of the flight of the stairs being visually noticeable to observers. For commercial flights of stairs, the relieved portion is disposed on an angle of about 30 degrees.

45 Claims, 6 Drawing Sheets

OTHER PUBLICATIONS

Cabinet Factory, "Where Custom Made Quality Begins," Cabinet Factory, Inc., 1983, 4 pages.
The Hyde Park Raised Panel Systems, The Return of Elegance at an Affordable Price, Hyde Park Lumber Company, 1989, 5 pages.
Mid–America Building Products, A Tapco International Company. The Mid–America Master Series, 1997, 4 pages.
How To Install Plywood Wall Paneling, Georgia–Pacific Corporation, 1993, 2 pages.
SelecTrim Panelling System, The James Wood Company, Feb. 24, 1993, 3 pages.
"The Cost of Sold Wood Raised Panels Is Ridiculous!!!", American Panels, May/Jun. 1993, 2 pages.
Miscellaneous Millworks, Woodharbor, 1996, pp. MM1–MM4.
Estate Winscotting Library Systems, Mantlecraft, Inc., Mar. 1995, 4 pages.
New England Classic Raised Panel System, New England Classic Interiors, 1996, Booklet and Installation Guide, pp. 1–15.
New England Classic Raised Panel System, Brochure describing features, benefits, installations, parts, etc. (1997).

* cited by examiner

ADJUSTABLY SIZEABLE RAISED PANEL SYSTEM FOR STAIRS AND METHOD FOR FORMING AND INSTALLING SAME

BACKGROUND OF THE INVENTION

The present invention relates generally to raised panel systems, and more specifically, to raised panel systems attachable to a lower portion of a wall along a flight of stairs.

Conventional decorative raised panel systems are installed over a horizontally-extending, lower portion of an interior partition or wall of a room. Typically, raised panel systems include an upper rail, a lower rail, and a plurality of alternating rectangularly-shaped panels and sites.

Oftentimes, it is desirable to install raised panels along the lower portion of a wall along a flight of stairs. Typically, each flight of stairs has a specific slope or rise to run ratio which requires that the raised panels and stiles be custom made. For example, after the stairway is built, a carpenter initially obtains measurements of the rise and run of the flight of stairs to determine the exact slope or angle of the flight of stairs. The carpenter then fabricates custom-sized parallelogram-shaped raised panels and stiles matching the angle of the flight of stairs. The custom-sized parallelogram-shaped raised panels have an outer frame having a constant cross-section along the sides, i.e., top, bottom, and opposite vertical sides. Drawbacks with this approach for installing raised panels to the lower portion of a wall along a flight of stairs is that the fabrication of custom-sized raised panels and stiles is complicated, time consuming, and requires highly skilled carpenters.

Therefore, there is a need for raised panels and raised panel systems which can be installed along flights of stairs having differing rises and runs or slopes.

SUMMARY OF THE INVENTION

The present invention provides, in a first aspect, an adjustably sizeable raised panel attachable to a wall along a flight of stairs in which the adjustably sizeable raised panel includes a parallelogram-shaped member having a pair of vertically-extending sides and generally parallel angled top and bottom sides. The parallelogram-shaped member has an outer frame having a relieved portion and a peripherally-extending portion. The peripherally-extending portion of the pair of vertically-extending sides has a first length and the peripherally-extending portion of the top and the bottom sides has a second length which is greater than the first length. Desirably, the relieved portion of the adjustably sizeable raised panel is disposed on an angle between about 37 degrees and about 41 degrees from horizontal.

In a second aspect, an adjustably sizeable raised panel system kit includes a plurality of the above-mentioned adjustably sizeable raised panels, and desirably a plurality of stiles, a top rail, and a bottom rail.

In a third aspect, a raised panel system includes a plurality of spaced-apart adjustably sizeable raised panels disposed on a lower portion of a wall along a flight of stairs having a slope. The plurality of raised panels includes a parallelogram-shaped member having a pair of vertically-extending sides and generally parallel angled top and bottom sides. The parallelogram-shaped member has an outer frame having a relieved portion and a peripherally-extending portion, and the relieved portions of the top and the bottom sides are disposed at an angle from horizontal which may be different from the slope of the flight of stairs.

In a fourth aspect, a method for decorating a wall of a flight of stairs having a rise and run defining slope of the stairs includes providing a plurality of the above-mentioned adjustably sizable raised panels, determining the slope of the stairs, trimming a top edge and a bottom edge of the plurality of the raised panels to correspond to the slope of the stairs, and attaching the plurality of trimmed adjustably sizable raised panels to the lower portion of the wall of the flight of stairs.

In a fifth aspect, a method for forming an adjustably sizeable raised panel attachable to a wall along a flight of stairs includes providing a parallelogram-shaped member having a pair of vertically-extending sides and generally parallel angled top and a bottom sides, and providing an outer frame having a relieved portion and a peripherally-extending portion. The peripherally-extending portion along the pair of vertically-extending sides has a first length and the peripherally-extending portion along the top and the bottom sides has a second length, which is greater than the first length.

BRIEF DESCRIPTION OF THE DRAWINGS

The subject matter which is regarded as the invention is particularly pointed out and distinctly claimed in the concluding portion of the specification. The invention, however, together with further objects and advantages thereof, may best be understood by reference to the following detailed description of the preferred embodiments and the accompanying drawings in which:

DETAILED DESCRIPTION OF THE INVENTION

Figure 1:
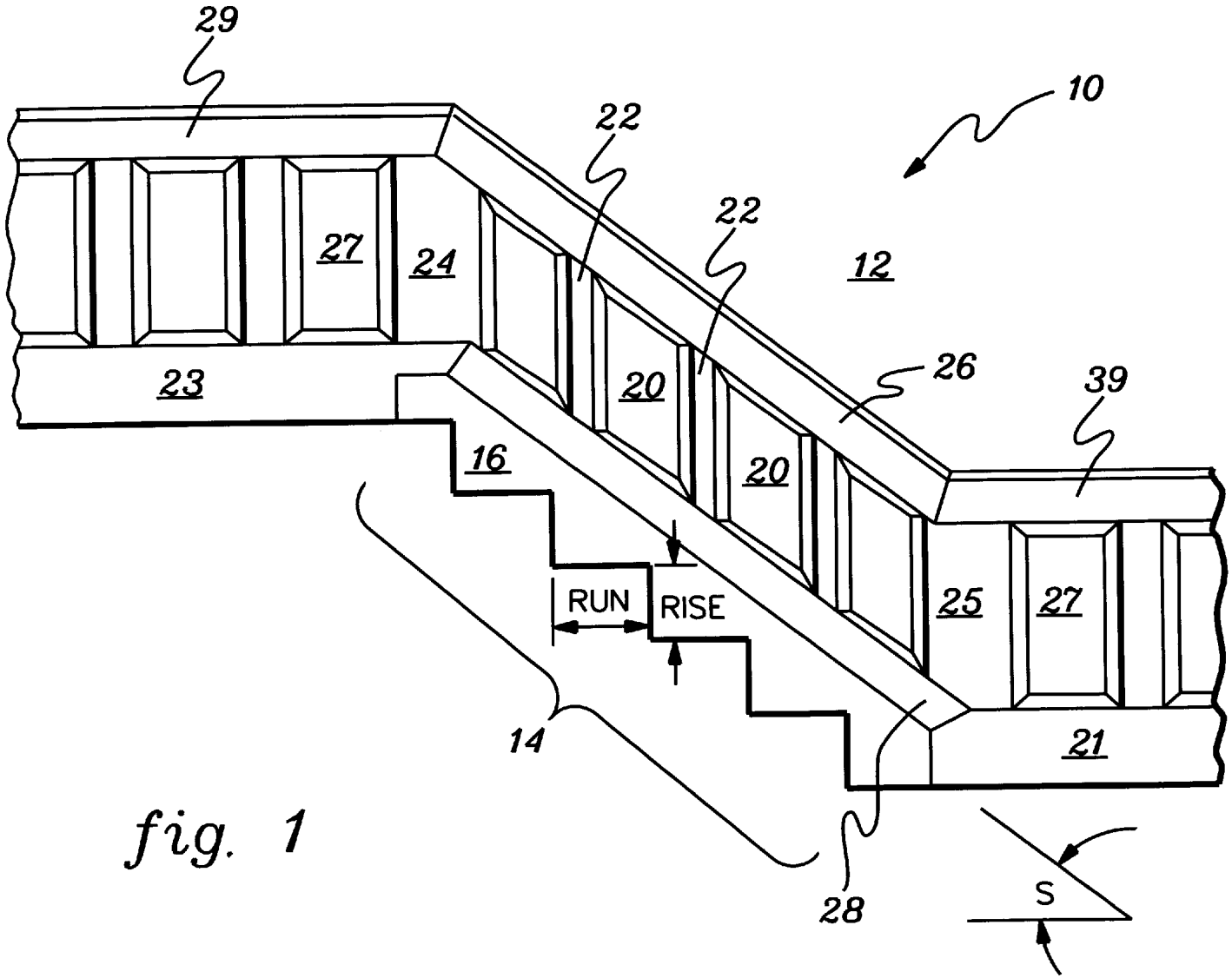
FIG. 1 is an elevational view of an adjustably sizeable raised panel system installed along a lower portion of a wall above a flight of stairs.

FIG. 1 illustrates one embodiment of an adjustably sizeable raised panel system 10 (e.g., wainscot) according to the present invention attached to a lower outer surface portion of a wall 12 along a flight of stairs 14. As explained in greater detail below, the adjustably sizeable raised panel system may be configured to extend along flights of stairs which have a range of or different rises and runs or slopes. The adjustably sizeable raised panel system is desirably readily trimmed by carpenters or homeowners to fit the slopes of common residential and commercial stairs, and is easily installed on the job site using conventional carpentry tools.

In this illustrated embodiment, adjustably sizeable raised panel system 10 includes a plurality of adjustably sizeable raised panels 20, a plurality of stiles 22, top and bottom stair stiles 24 and 25 for transitioning from adjustably sizeable raised panels 20 to horizontally extending rectangular-shaped raised panels 27, a top rail 26, and a bottom rail 28.

Figure 2:
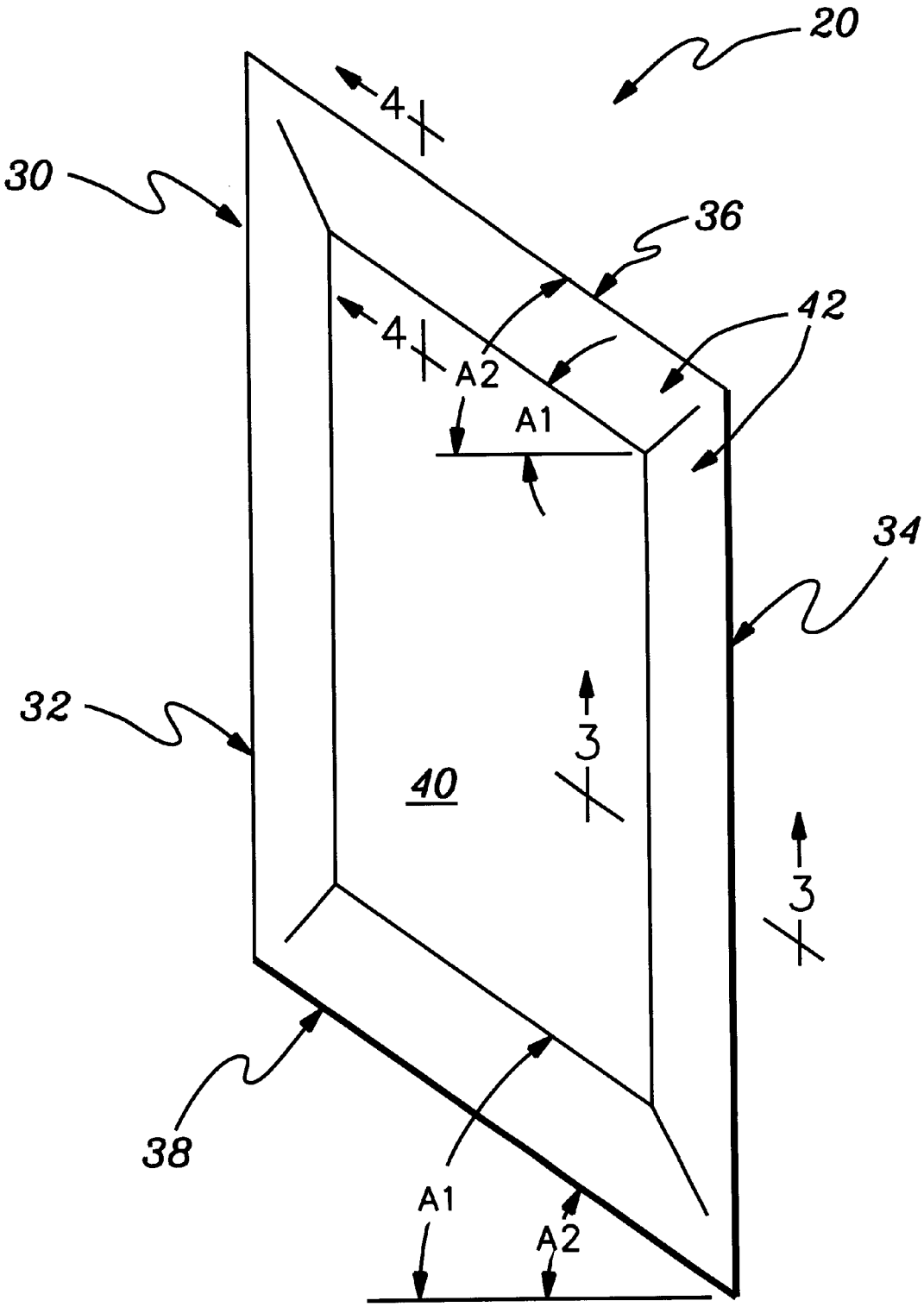
FIG. 2 is an enlarged view of one of the adjustably sizeable raised panels of FIG. 1.

FIG. 2 illustrates in greater detail, one of the adjustably sizeable raised panels 20. Adjustably sizeable raised panel 20 includes a parallelogram-shaped member 30 having a pair of vertically-extending sides 32 and 34, and generally parallel angled top and bottom sides 36 and 38, respectively. In addition, parallelogram-shaped member 30 includes a central portion 40 and an outer border or frame 42.

Figure 3:
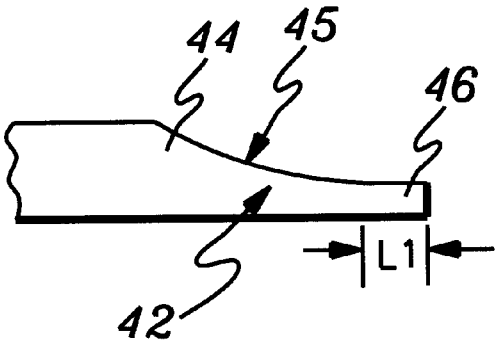
FIG. 3 is a cross-sectional view of a vertically-extending side of the adjustably sizeable raised panel taken along lines 3—3 of FIG. 2.
Figure 4:
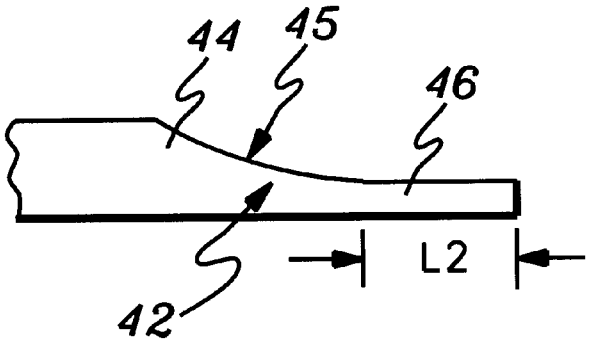
FIG. 4 is a cross-sectional view, rotated ninety degrees clockwise, of the top side of the adjustably sizeable raised panel taken along line 4—4 of FIG. 2.

As best shown in FIGS. 3 and 4, outer frame 42 (FIG. 2) includes a relieved portion 44 and a peripherally-extending portion 46 or tongue for desirably matingly-engaging a top rail, a bottom rail, and a pair of stiles. Peripherally-extending portions 46 of vertically-extending sides 32 and 34 (FIG. 2) have a first length L1 (FIG. 3) and peripherally-extending portions 46 of top and bottom sides 36 and 38 (FIG. 2) have a second length L2. Second length L2 is greater than first length L1 allowing the top and bottom sides to be trimmed to match the slope of the flight of stairs as explained in greater detail below. The length of second length L2 is typically between about ⅛ and ¾ inch greater than first length L1 and desirably at least about ½ inch greater than first length L1.

With reference again to FIG. 1, the rise and run of a flight of stairs of most building code complaint residential stairs range between about 6 ¾ inches and about 8½ inches for the rise and between about 9 inches and 10¾ inches for the run (not including the nosing or the typically rounded edge of a stair tread that projects over the riser) resulting in a slope S from horizontal of typically between about 35.5 degrees and about 42.5 degrees.

It has been found that the raised panels of the present invention having the relieved portion of top and bottom sides 36 and 38, respectively, disposed on an angle A1 (FIG. 2) of between about 37 degrees from horizontal and about 41 degrees from horizontal allows adjustment, e.g., trimming of the edges of the top and bottom sides, as explained below, to match the slope of about most residential stairs. The distal edge of the top and bottom sides may be disposed on an angle A2 which is desirably the same as A1.

Advantageously, the relieved portion of top and bottom sides 36 and 38, respectively, are disposed on an angle A1 (FIG. 2) of either about 37 degrees from horizontal or about 41 degrees from horizontal which allows adjustment by trimming of the edges of the top and bottom sides of up to plus or minus 1¾ degrees (preferably less than plus or minus 1 ½ degrees) to match the slope of about most residential stairs without the difference between angle A1 of relieved portions 44 of the top and bottom sides and the slope S of the flight of the stairs (e.g., the angle of the top and the bottom rail) being visually noticeable to observers.

Commercial building code compliant stairs typically have a slope S of about 30 degrees from horizontal. Raised panels of the present invention for installation along a flight of commercial stairs have the relieved portion of the top and bottom sides 36 and 38, respectively, disposed on an angle A1 (FIG. 2) of about 30 degrees from horizontal to allow adjustment, e.g., trimming of the edges of the top and bottom sides, as explained below, to match the actual slope of the commercial stairs.

Figure 5:
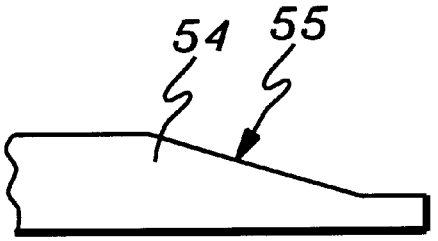
FIGS. 5 and 6 are views of an alternative embodiment of the sides of an adjustably sizeable raised panel similar to FIG. 3 and 4, respectively.
Figure 6:
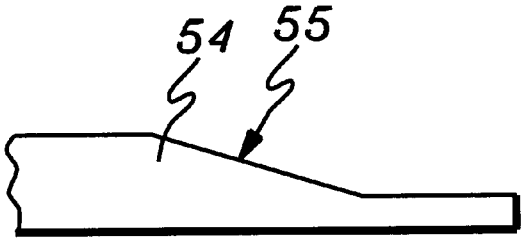
Figure 7:
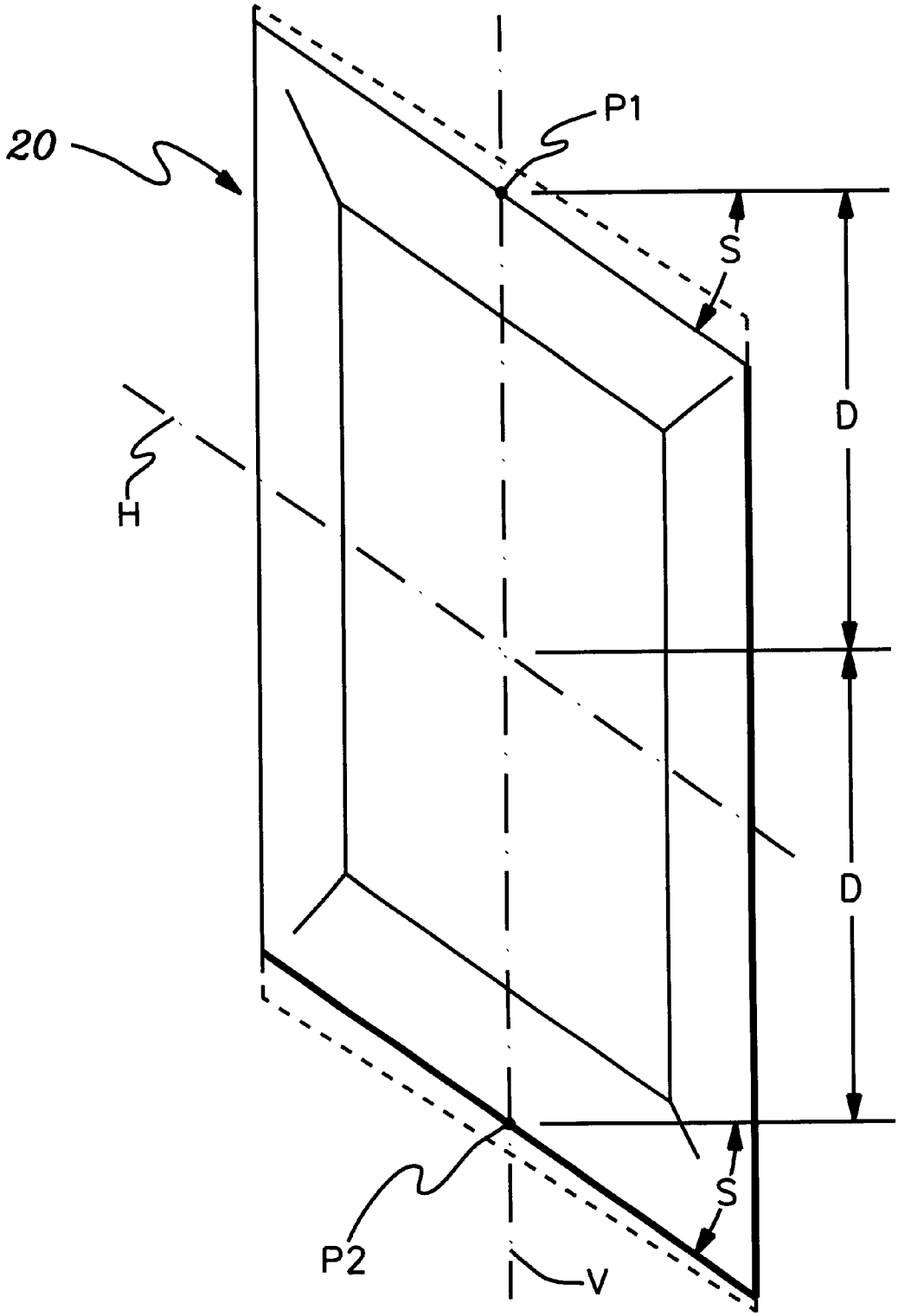
FIG. 7 is an elevational view illustrating the process for marking and trimming the adjustably sizeable raised panel shown in FIG. 2.

Relieved portion 44, as shown in FIGS. 3 and 4, includes a concave surface 45. Alternatively, as shown in FIGS. 5 and 6, an adjustably raised panel may include a relieved portion 54 having a slanted surface 55. From the present description, it will be appreciated by those skilled in the art that other configurations for the relieved portion would be equally suitable.

FIGS. 7–13 illustrate the process for installing adjustably sizeable raised panel system 10 (FIG. 1). Initially, with reference to FIG. 7, the top and bottom sides of adjustably sizable raised panel 20 are marked and cut to correspond to slope S (FIG. 1) of flight of stairs 14 (FIG. 1). For example, a vertical centerline V and horizontal centerline H or portions thereof are marked on adjustably sizeable raised panel 20. From the intersection of vertical centerline V and horizontal centerline H, points P1 and P2 are marked on vertical centerline V at distance D (typically between about 10 inches and 18 inches) above and below the intersection of vertical centerline V and horizontal centerline H. Through points P1 and P2, lines are drawn at an angle from horizontal corresponding to slope S (FIG. 1) of flight of stairs 14 (FIG. 1) and the outer peripheral edge of the top and the bottom sides of the adjustably sizable raised panel 20 are cut along the drawn lines.

Figure 8:
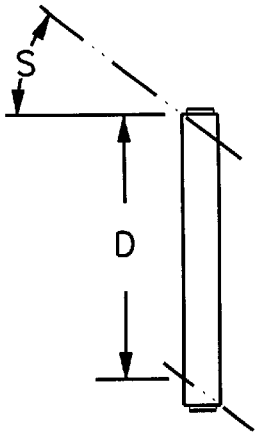
FIGS. 8–10 are elevational views illustrating the fabrication of a stile.
Figure 9:
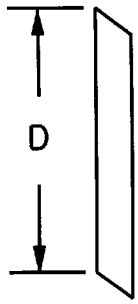
Figure 10:
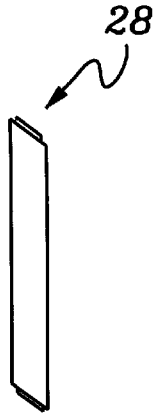

As shown in FIG. 8, spaced-apart lines are drawn at an angle from horizontal corresponding to slope S at a vertical distance D on, for example, a stile for use on a horizontally-extending portion of a raised panel system. The stile is cut along the drawn lines, FIG. 9, and dados are desirably cut in the ends as shown in FIG. 10 to form stile 22.

Figure 11:
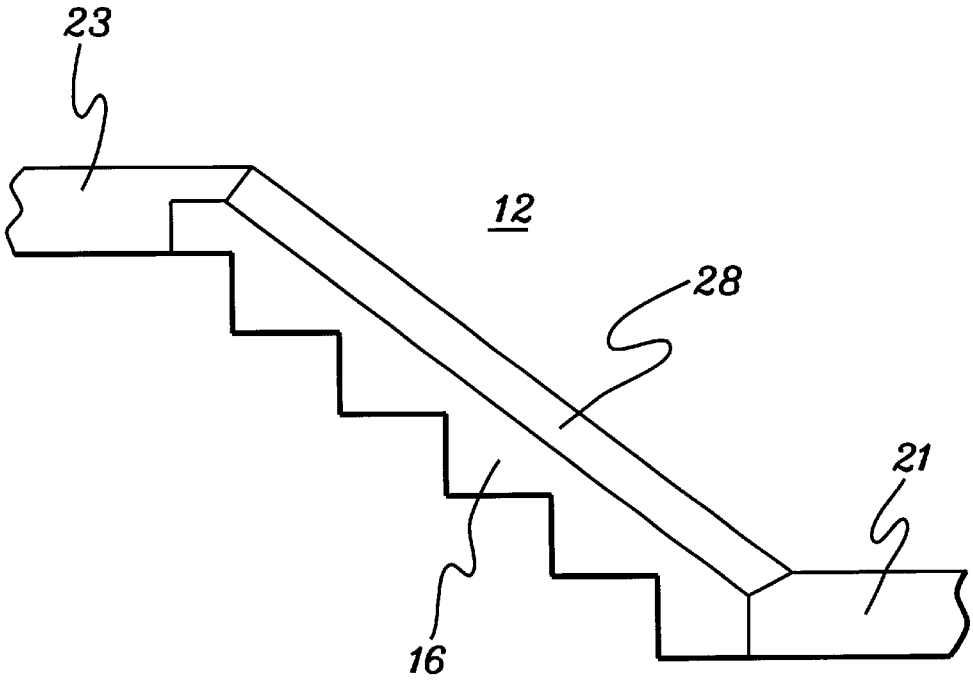
FIGS. 11–13 are elevational views illustrating the process of installing the adjustably sizable raised panel system of FIG. 1 to the wall along the flight of stairs, and fabrication of the top and bottom stiles.

With reference to FIG. 11, bottom stair rail 28, for example, either a four inch or eight inch wide rail, is fitted to a stair stringer 16 and attached to wall 12. Horizontal rails 21 and 23 are then cut and fitted to stair stringer 16 and bottom stair rail 28.

Figure 12:
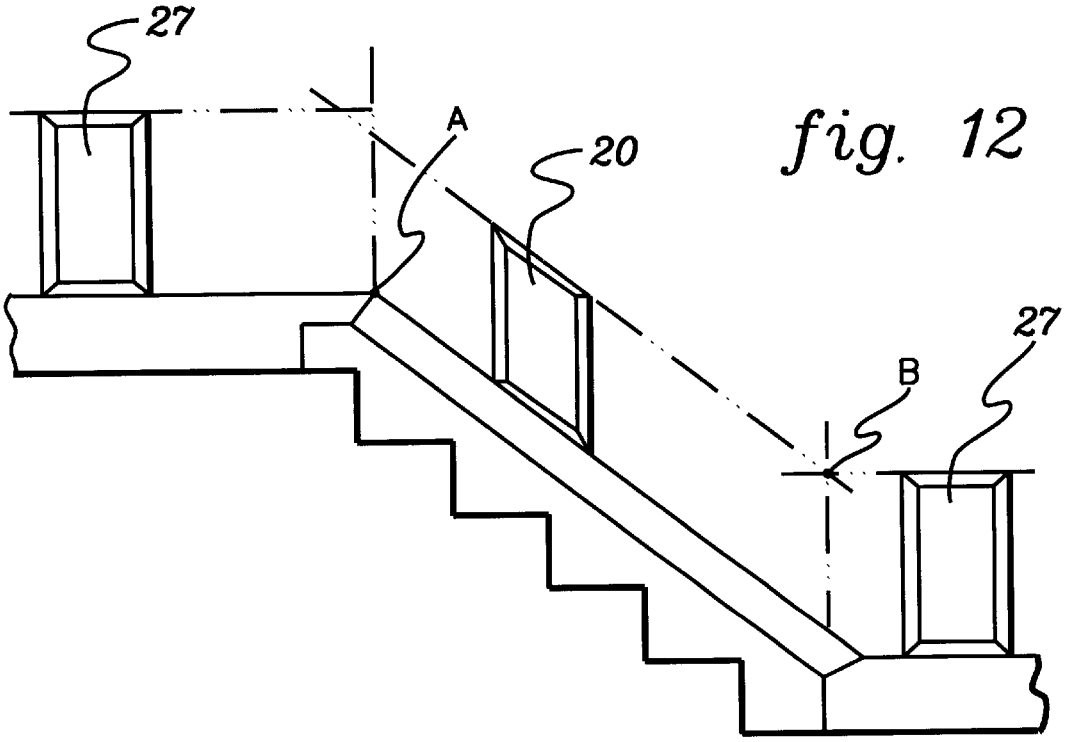
Figure 13:
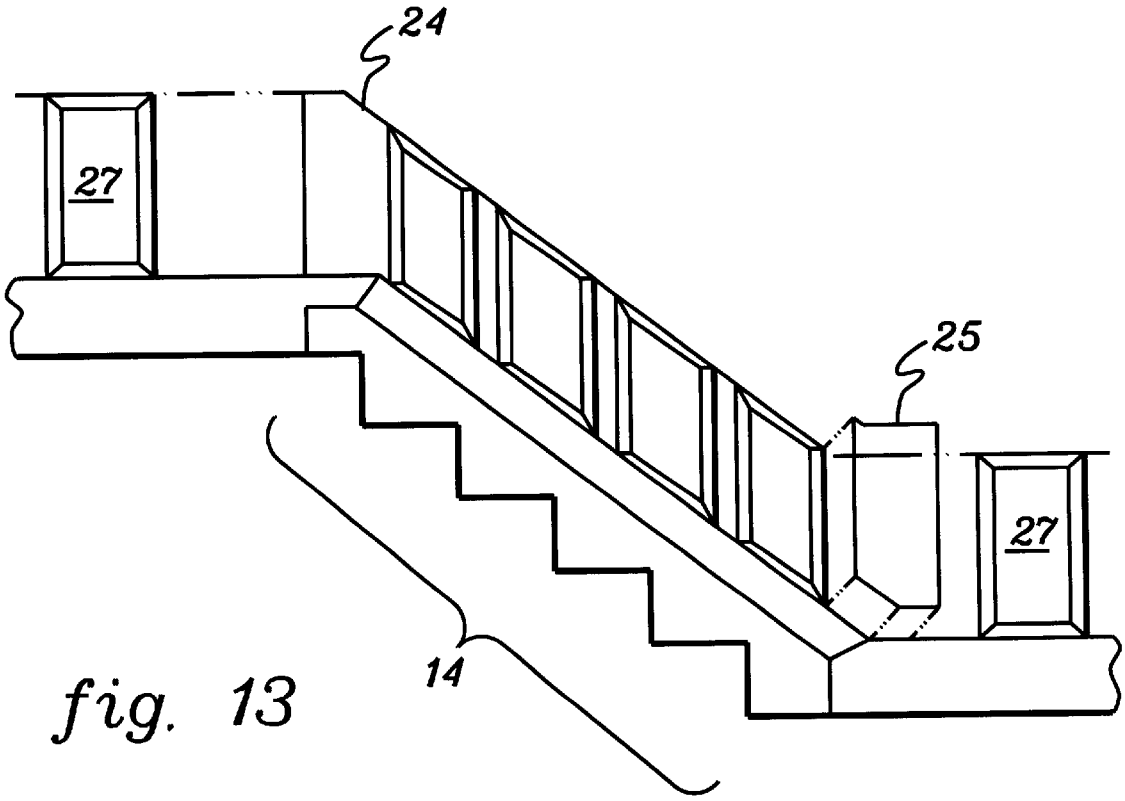

Using the trimmed adjustably sizable raised panels 20 and rectangular-shaped raised panels 27 as guides, as shown in FIG. 12, horizontal and inclined lines are marked on wall 12 corresponding to the upper edges of the raised panels. Next, vertical lines are drawn through a point A and a point B, as shown in FIG. 12, for laying out panels 20 and stiles 22 (FIG. 10) so that there are equal gaps or clearances between the uppermost and lowermost raised panels and the lines through point A and point B.

At the top and the bottom of flight of stairs 14, top and bottom stiles 24 and 25, respectively, are marked and trimmed to make the transitions between rectangular-shaped raised panels 27 and trimmed adjustably sizable raised panels 20. After the top and bottom stiles are trimmed, dados are cut in the upper and lower ends thereof.

After placing all panels and stiles in position, top rails 26, 29, and 39 are slid into place as best shown in FIG. 1. At the location of the studs in wall 12, desirably nail holes are predrilled in the top rails. The top rails are then fastened with finishing nails. Desirably, chair rail caps are cut and fastened to the top rails with adhesive and smaller finishing nails. It will be appreciated that the adjustably sizeable raised panel system may be attached or supported to a wall in other ways known in the art such as, for example, using adhesives or pneumatic power nailers. In addition, desirably, the system includes interlocking joining or overlapping continuous grooves and tongues that sandwich the raised panels and stiles between the rails thereby enabling installation without coping.

From the present description, it will also be appreciated by those skilled in the art that the adjustably sizeable raised panels may be fabricated as one-piece or an integral unit, or may be fabricated from two or more separate pieces, i.e., veneers or where the border or other frame comprises a plurality of pieces which are attached to a central portion.

The adjustably sizeable panels may be formed from wood such as oak, maple, pine, etc. or other suitable materials. In addition, the present invention is suitable with other decorative parallelogram-shaped panels, such as, for example, traditional raised panels, beadboard panels, recessed flat panels, or modern flat panels with shadow relief.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. An adjustably sizeable raised panel attachable to a wall along a flight of stairs, said adjustably sizeable raised panel comprising:

a parallelogram-shaped member having a pair of vertically-extending sides, and generally parallel angled top and bottom sides;

said parallelogram-shaped member having an outer frame having a relieved portion and a peripherally-extending portion;

said peripherally-extending portion of said pair of vertically-extending sides comprising a first length and said peripherallyextending extending portion of said top and said bottom sides comprising a second length; and wherein said second length is greater than said first length.

2. The adjustably sizeable raised panel of claim 1 wherein said relieved portion of said top and bottom sides is disposed on an angle of between about 37 degrees and about 41 degrees from horizontal.

3. The adjustably sizeable raised panel of claim 1 wherein said relieved portion of said top and bottom sides is disposed on an angle of about 37 degrees from horizontal.

4. The adjustably sizeable raised panel of claim 1 wherein said relieved portion of said top and bottom sides is disposed on an angle of about 41 degrees from horizontal.

5. The adjustably sizeable raised panel of claim 1 wherein said relieved portion of said top and bottom sides is disposed on an angle of about 30 degrees from horizontal.

6. The adjustably sizeable raised panel of claim 1 wherein said second length is between about ¼ inch and ¾ inch greater than said first length.

7. The adjustably sizeable raised panel of claim 1 wherein said second length is at least about ½ inch greater than said first length.

8. The adjustably sizeable raised panel of claim 1 wherein said relieved portion comprises a concave surface.

9. The adjustably sizeable raised panel of claim 1 wherein said relieved portion comprises a slanted surface.

10. An adjustably sizeable raised panel kit attachable to a wall along a flight of stairs, said kit comprising:

a plurality of adjustably sizeable raised panels, some of said plurality of adjustably sizeable raised panels comprising a parallelogram-shaped member having a pair of vertically-extending sides and generally parallel angled top and bottom sides;

said parallelogram-shaped member having an outer frame having a relieved portion and a peripherally-extending portion;

said peripherally-extending portion of said vertically-extending sides comprising a first length and said peripherally-extending portion of said top and said bottom sides comprising a second length; and wherein said second length is greater than said first length.

11. The kit of claim 10 further comprising a plurality of stiles.

12. The kit of claim 11 further comprising a top rail and a bottom rail.

13. The kit of claim 10 wherein said relieved portion of said top and bottom sides is disposed on an angle of between about 37 degrees and about 41 degrees from horizontal.

14. The kit of claim 10 wherein said relieved portion of said top and bottom sides is disposed on an angle of about 37 degrees from horizontal.

15. The kit of claim 10 wherein said relieved portion of said top and bottom sides is disposed on an angle of about 41 degrees from horizontal.

16. The kit of claim 10 wherein said relieved portion of said top and bottom sides is disposed on an angle of about 30 degrees from horizontal.

17. The kit of claim 10 wherein said second length is between about ¼ inch and ¾ inch greater than said first length.

18. The kit of claim 10 wherein said second length is at least about ½ inch greater than said first length.

19. The kit of claim 10 wherein said relieved portion comprises a concave surface.

20. The kit of claim 10 wherein said relieved portion comprises a slanted surface.

21. A raised panel system installed along a lower portion of a wall of a flight of stairs having a slope, said system comprising:

a plurality of spaced-apart adjustably sizeable raised panels disposed on the lower portion of the wall along the flight of stairs;

said plurality of raised panels comprising a parallelogram-shaped member having a pair of vertically-extending sides, and generally parallel angled top and bottom sides;

said parallelogram-shaped member having an outer frame having a relieved portion and a peripherally-extending portion;

said relieved portion of said top and said bottom sides being disposed at an angle from horizontal; and wherein said angle is different from the slope of the flight of stairs.

22. The system of claim 21 wherein said angle is within about 1¾ degrees of the slope of the flight of stairs.

23. The system of claim 21 wherein said angle is between about 37 degrees and about 41 degrees from horizontal.

24. The system of claim 21 wherein said angle is about 37 degrees from horizontal.

25. The system of claim 21 wherein said angle is about 41 degrees from horizontal.

26. The system of claim 21 wherein said angle is about 30 degrees from horizontal.

27. The system of claim 21 further comprising a plurality of stiles, and wherein said system comprises alternating raised panels and stiles disposed on the lower portion of the wall along the flight of stairs.

28. The system of claim 27 further comprising a top rail and a bottom rail disposed on the wall above and below, respectively, said alternating raised panels and stiles.

29. The system of claim 21 wherein said relieved portion comprises a concave surface.

30. The system of claim 21 wherein said relieved portion comprises a slanted surface.

31. A method for decorating a wall of a flight of stairs having a rise and run defining a slope of the stairs, the method comprising:

providing a plurality of adjustably sizable raised panels of claim 1;

determining the slope of the stairs;

trimming a top edge and a bottom edge of the plurality of raised panels to correspond to the slope of the stairs; and attaching the plurality of trimmed adjustably sizable raised panels to the lower portion of the wall of the flight of stairs.

32. The method of claim 31 wherein the trimming comprises marking a vertical centerline and a horizontal centerline on the plurality of panels, marking the vertical centerline at a predetermined distance above and below an intersection of the vertical centerline and the horizontal centerline to define a first point and a second point, and marking lines corresponding to the slope of the flight of stairs through the first point and the second point.

33. The method of claim 32 wherein the predetermined distance is between about 10 inches and about 18 inches.

34. The method of claim 32 wherein the predetermined distance is about 10 inches.

35. The method of claim 31 further comprising providing a plurality of stiles and attaching alternating trimmed raised panels and stiles to the lower portion of the wall along the flight of stairs.

36. The method of claim 35 further comprising providing a top rail and a bottom rail and attaching the top rail and the bottom rail above and below, respectively, the alternating trimmed raised panels and stiles.

37. A method for forming an adjustably sizeable raised panel attachable to a wall along a flight of stairs, the method comprising:

providing a parallelogram-shaped member having a pair of vertically-extending sides, and generally parallel angled top and bottom sides; and providing an outer frame having a having a relieved portion and a peripherally-extending portion, the peripherally-extending portion along the vertically-extending sides comprising a first length and the peripherally-extending portion along the top and the bottom sides comprising a second length, and wherein the second length is greater than the first length.

38. The method of claim 37 wherein the relieved portion of the top and bottom sides is disposed on an angle of between about 37 degrees and about 41 degrees from horizontal.

39. The method of claim 37 wherein the relieved portion of the top and bottom sides is disposed on an angle of about 37 degrees from horizontal.

40. The method of claim 37 wherein the relieved portion of the top and bottom sides is disposed on an angle of angle about 41 degrees from horizontal.

41. The method of claim 37 wherein the relieved portion of the top and bottom sides is disposed on an angle of angle about 30 degrees from horizontal.

42. The method of claim 37 wherein said second length is between about ¼ inch and ¾ inch greater than said first length.

43. The method of claim 37 wherein said second length is at least about ½ inch greater than said first length.

44. The method of claim 37 wherein the relieved portion comprises a concave surface.

45. The method of claim 37 wherein the relieved portion comprises a slanted surface.

* * * * *

UNITED STATES PATENT AND TRADEMARK OFFICE

CERTIFICATE OF CORRECTION

PATENT NO. : 6,374,562 B1
DATED : April 23, 2002
INVENTOR(S) : Crowley

It is certified that error appears in the above-identified patent and that said Letters Patent is hereby corrected as shown below:

Title page,
Item [12], delete "Crowly" and replace with -- Crowley --
Item [75], Inventor, delete "Crowly" and replace with -- Crowley --

Signed and Sealed this

Twenty-fourth Day of September, 2002

*Attest:*

*Attesting Officer*

JAMES E. ROGAN
*Director of the United States Patent and Trademark Office*